US006389811B2

(12) United States Patent
Urasawa et al.

(10) Patent No.: US 6,389,811 B2
(45) Date of Patent: May 21, 2002

(54) STIRLING CYCLE ENGINE

(75) Inventors: Hideto Urasawa; Kentaro Suzuki; Takeshi Suzuki, all of Niigataken (JP)

(73) Assignee: Twinbird Corporation, Niigata-ken (JP)

( * ) Notice: Subject to any disclaimer, the term of this patent is extended or adjusted under 35 U.S.C. 154(b) by 0 days.

(21) Appl. No.: 09/874,617

(22) Filed: Jun. 5, 2001

(30) Foreign Application Priority Data

Jun. 13, 2000 (JP) ..... 2000-177278

(51) Int. Cl.[7] ..... F01B 29/10
(52) U.S. Cl. ..... 60/517; 60/520
(58) Field of Search ..... 60/517, 519, 520

(56) References Cited

U.S. PATENT DOCUMENTS 4,400,941 A * 8/1983 Rauch ..... 60/520
5,056,419 A * 10/1991 Watanabe et al. ..... 92/80
5,743,091 A * 4/1998 Penswick et al. ..... 60/517
6,112,606 A * 9/2000 Shin ..... 74/44

FOREIGN PATENT DOCUMENTS

JP 10-336994 12/1998
JP 11-182476 6/1999
JP 11-201035 7/1999
JP 11-325057 11/1999
JP 2000-54957 2/2000

* cited by examiner

*Primary Examiner*—Hoang Nguyen
(74) *Attorney, Agent, or Firm*—Quarles & Brady LLP

(57) ABSTRACT

A stirling cycle engine whose cylinder, including a mount, can be easily fabricated and securely attached. The stirling cycle engine of the invention comprises a casing having a cylindrical portion 2; a metallic cylinder 7 coaxially inserted into the cylindrical portion 2 of the casing 1; a piston 15 inserted into the cylinder 7; a drive mechanism 16 for reciprocally driving the piston 15; and a mount 28 which is attached to an outer periphery of the cylinder 7 for fixing the cylinder 7 to the casing 1 and retaining the drive mechanism 16. The mount 28 is made of a material of low heat conductance, constructed separately from the cylinder 7. The mount 28 is attached to the outer periphery of the cylinder 7. Thus, the easier working thereof is resulted, so that the working time is shortened, to thereby improve productivity, and reduce working costs. Further, The heat from the drive mechanism 16 is less likely to transfer to the cylinder 7 via the mount 28.

10 Claims, 4 Drawing Sheets

STIRLING CYCLE ENGINE

BACKGROUND OF THE INVENTION a) Field of the Invention

The present invention relates to a free-piston type stirling cycle engine, particularly to the structure of a cylinder mounted inside an apparatus body.

b) Prior Art

A stirling cycle engine allows a piston to reciprocate in a cylinder in the axial direction, so that when the piston is shifted toward a displacer, a gas inside a compression chamber formed between the piston and the displacer is compressed, and then it passes through a heat dissipating fin, a regenerator and an endothermic or heat absorbing fin, to reach an expansion chamber formed between the tip end of the displacer and the tip end of a casing, thus pushing the displacer downward. On the other hand, when the piston is shifted to the opposite direction, then the inside of the compression chamber is subjected to a negative pressure, so that the gas returns from the expansion chamber to the compression chamber inside the cylinder, via the heat absorbing fin, the regenerator and the heat dissipating fin, thereby pushing the displacer upwardly. Through such steps, the operation of a reversible cycle consisting of isothermal change and isovolumic change is carried out, whereby the temperature of the heat absorbing fin mounted to the peripheral tip end of the cylinder is lowered, while the temperature of the heat dissipating fin mounted to the outer periphery of a base is raised.

Conventionally, the above-mentioned cylinder has heretofore been produced by machining a pole-shaped metallic material, such as aluminum alloy, steels of various kinds or the like, and there has been a mount portion provided in the cylinder, for the purpose of fixing the cylinder to the casing and retaining a drive mechanism for reciprocating the piston. For improving accuracy, such mount portion would be machined with the same being integral with the cylinder.

However, for forming the cylinder integral with such mount by means of machining process, it is necessary to machine a metallic pole material that is thicker than the outer dimension of the mount, so that a considerable portion of the material becomes metal filing, thus consuming longer time for machining, leading to inferior productivity. Further, as the outer dimension of the mount is comparatively large, a large-sized machining machine is needed, thus causing the increase of costs.

For an alternative method for forming the cylinder with such mount, it is proposed that an approximate configuration may be first obtained by forging or casting a material, and then machining the material. In that case, however, the amount of metal filing is decreased, but the costs are eventually increased due to the forging or casting process prior to the machining process, and thus there is no substantial difference in final costs.

As a further conceivable method for forming the cylinder with such mount, the use of phenolic molding may be considered, which, however, requires a draft angle, and thus at least the machining inside the cylinder is needed, thus leading to a likelihood to degrade the accuracy due to thermal expansion or elastic deformation. As is apparent from the above-mentioned, conventional manufacture of a cylinder integrally formed with a mount has had problems in respect of costs and accuracy.

In addition, as the drive mechanism retained by the mount in a stirling cycle engine reaches a high temperature, there is a risk that the heat of the drive mechanism transfers from the mount to the cylinder, and then transfers to the compression space inside the cylinder, so that the thermal expansion of the cylinder is liable to occur to thereby produce a larger clearance between the cylinder and the piston, and/or the flow of the heat into the compression space is liable to damage the stirling cycle operation itself. Conversely, there has been a risk that the heat inside the compression space transfers to the drive mechanism via the cylinder and the mount, so that the drive mechanism is overheated.

SUMMARY OF THE INVENTION

Accordingly, it is a main object of the present invention to provide a stirling cycle engine in which a cylinder with a mount is able to be easily manufactured and installed.

It is another object of the present invention to provide a stirling cycle engine which is subjected to less damage by heat emitted from a drive mechanism.

To attain the above objects, there is provided a stirling cycle engine, comprising: a casing which at least includes a substantially cylinder-shaped cylindrical portion; a metallic cylinder that is coaxially inserted into the cylindrical portion of the casing; a piston inserted into the cylinder; a drive mechanism for reciprocally driving the piston; and a mount which is attached to an outer periphery of said cylinder for fixing the cylinder to said casing and retaining said drive mechanism, wherein said mount is made of a material of low heat conductance, substantially disc-shaped, having an attachment hole in the center thereof. Thus, working process therefor becomes easier, so that the working time is shortened, to thereby improve productivity, and reduce working costs. Further, The heat emitted from the drive mechanism is less likely to be transferred to the cylinder or to the compression chamber inside the cylinder via the mount.

From another aspect of the invention, there is provided a stirling cycle engine as set forth in the preceding paragraph, further comprising: a bar and a male screw which are formed around the outer periphery of said cylinder coaxially therewith; and a recess and a female screw which are formed around an inner periphery of said mount coaxially therewith so that said bar may be inserted into the recess with a slight clearance therebetween and the said male screw may be screwed into the female screw. Thus, the mount can be quite easily and firmly attached to the cylinder.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which:

FIG. 1 is a section of a stirling cycle engine according to an embodiment of the invention, while FIG. 1*a* is a partly enlarged section thereof.

DESCRIPTION OF PREFERRED EMBODIMENTS

Figures 1, 1A:
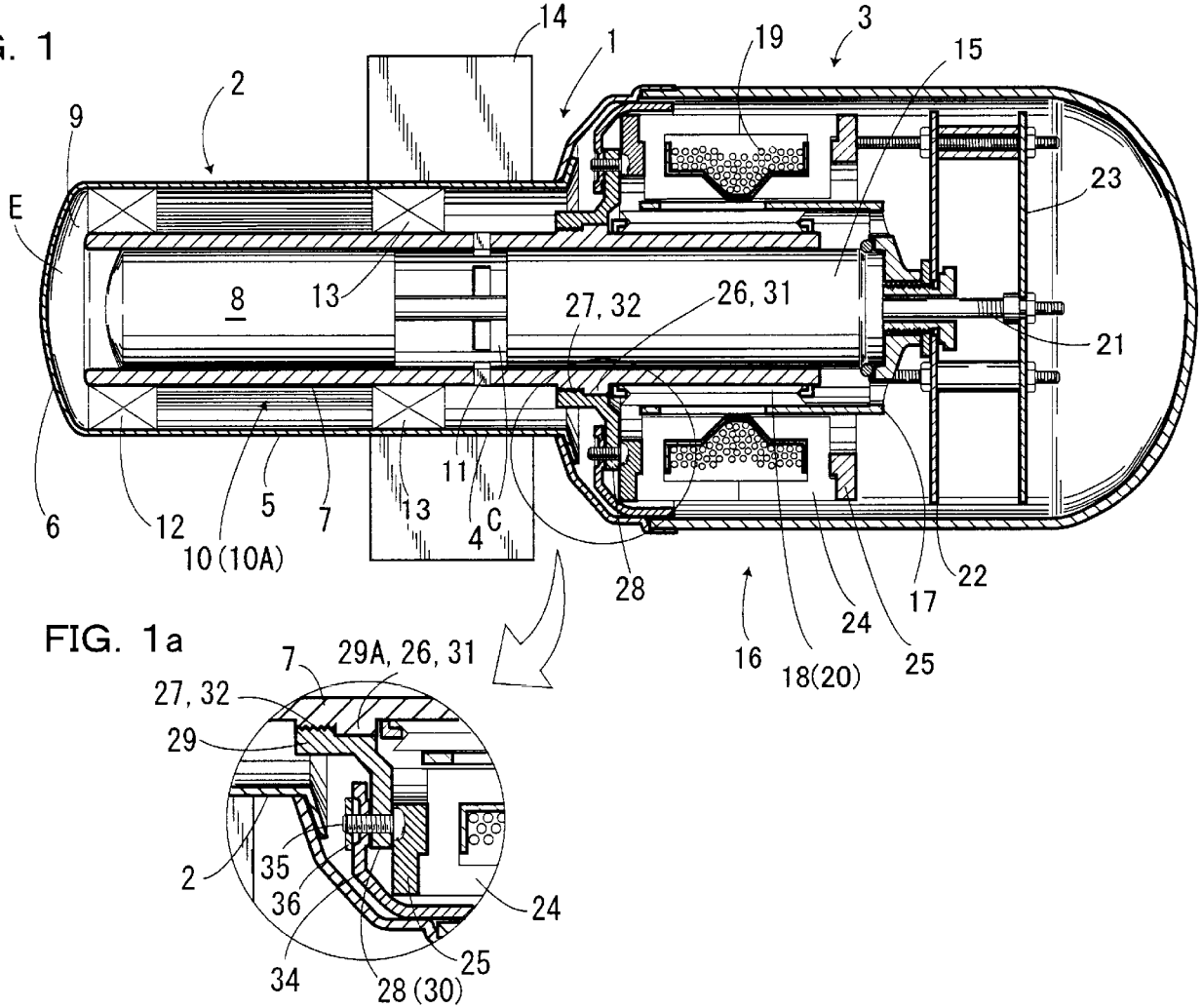
Figure 2:
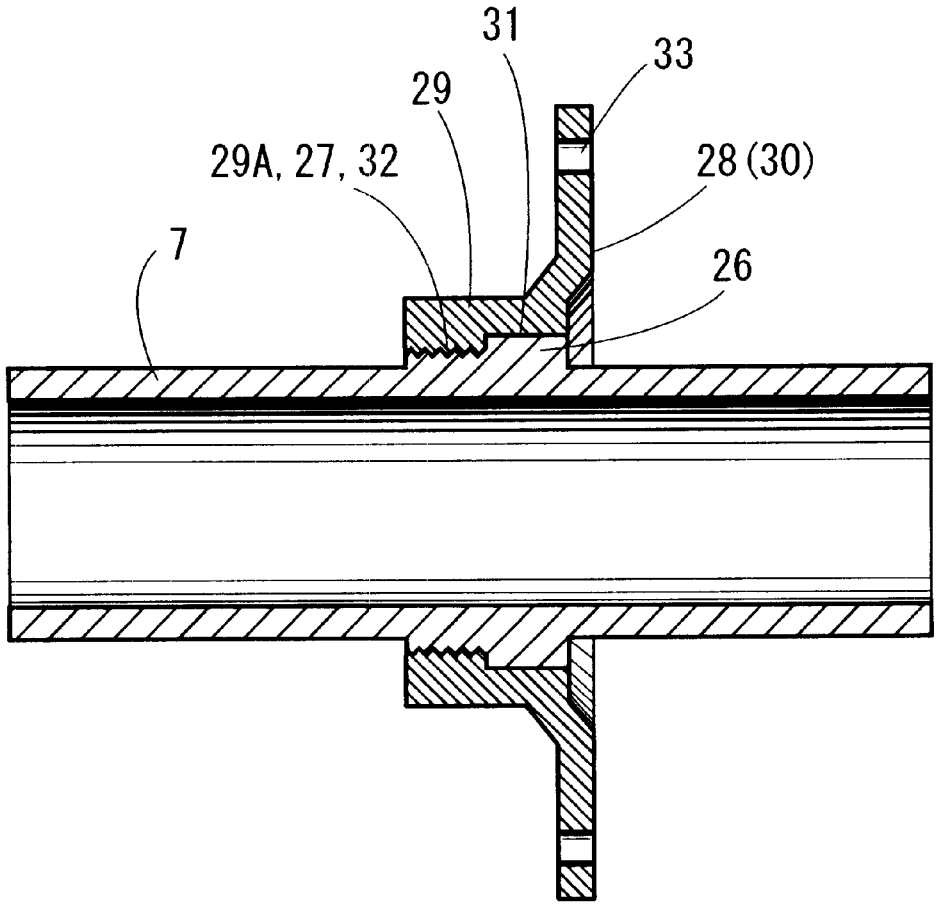
FIG. 2 is a section of an embodiment of the invention, particularly illustrating a cross-sectional view of the neighborhood of a cylinder.
Figure 3:
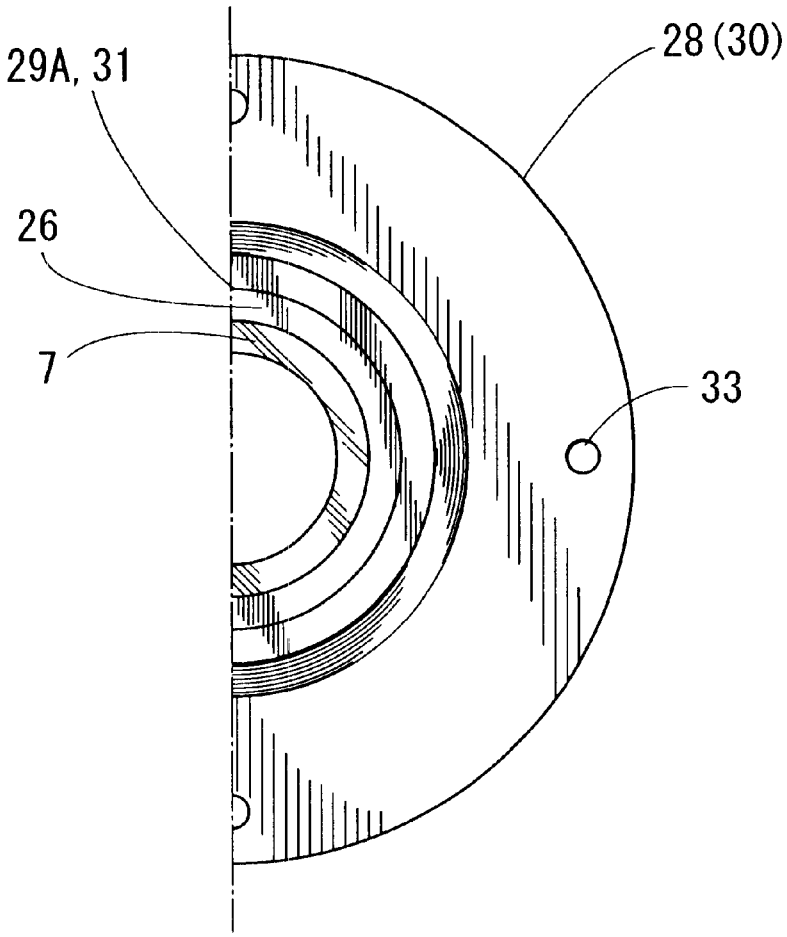
FIG. 3 is a transverse section of an embodiment of the invention, particularly illustrating a semi-sectional view of the neighborhood of the cylinder.
Figure 4:
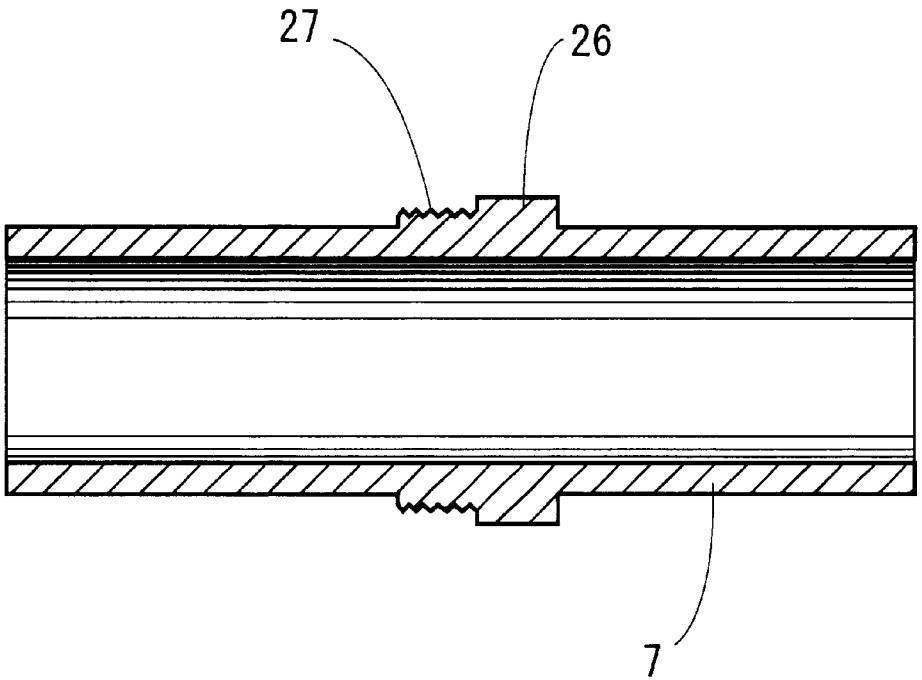
FIG. 4 is an exploded cross-sectional view showing the neighborhood of the cylinder of an embodiment of the invention.
Figure 4:
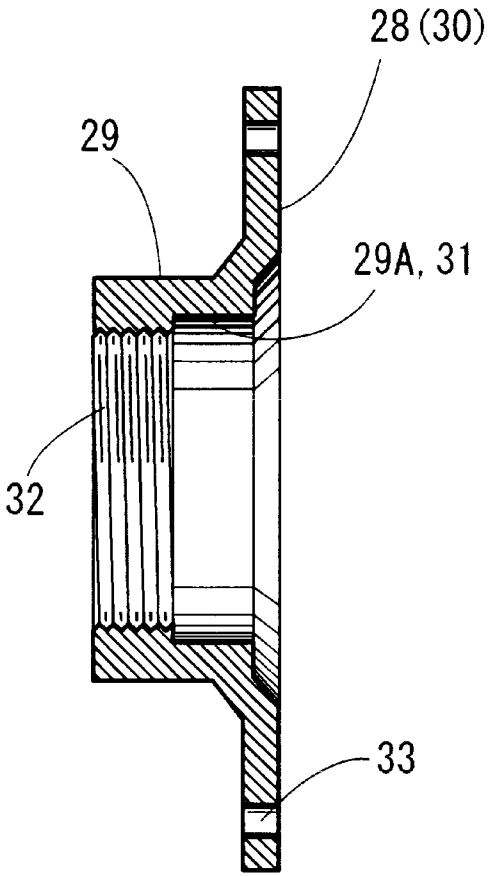

Hereinafter is described a preferred embodiment of the present invention with reference to FIGS. 1 through 4, in which reference numeral 1 designates a casing constructed of a substantially cylinder-shaped cylindrical portion 2 and a main body portion 3. The cylindrical portion 2 is made from stainless steel or the like, comprising a proximal portion 4, an intermediate portion 5 and a distal portion 6 which are integrally formed with one another.

Inside the cylindrical portion 2 is provided a cylinder 7 that is coaxially inserted into the same, extending to the main body 3. Inside the cylinder 7 is provided a displacer 8 in a manner capable of sliding in the axial direction. Between the distal end of the displacer 8 and the distal portion 6 of the cylindrical portion 2 is formed an expansion chamber E, while a space 9 provides the communication of the inside of the cylinder 7 with the outside thereof. Around the outer periphery of the cylinder 7 in the intermediate portion 5 is provided a regenerator 10, while in the proximal portion 4 is provided a communication hole 11 for allowing the inside of the cylinder 7 to communicate with the outside thereof. Around the outer periphery of the distal end of the cylinder 7 is provided a heat absorbing fin 12, while around the outer periphery of the cylinder 7 between the regenerator 10 and the communication hole 11 is provided a heat dissipating fin 13. Thus, a path of flow is formed to extend from the distal end of the inside of the cylinder 7, through the space 9, heat absorbing fin 12, regenerator 10, heat dissipating fin 13 and communication hole 11, up to the compression chamber C inside the cylinder 7.

To the outer periphery of the proximal portion 4 is mounted an outer heat dissipating fin 14. Inside the main body 3, a piston 15 is housed in the cylinder 7 in a manner capable of sliding in the axial direction. The proximal portion of the piston 15 is coaxially connected to a drive mechanism 16. The drive mechanism 16, which serves to reciprocally drive the piston 15, comprises a frame 17 which is shaped into a short cylinder configuration, a group of magnets 18 fixed to one end of the frame 17, and an annular electromagnetic coil 19 provided adjacent to the outer periphery of the group of magnets 18. The group of magnets 18 is constructed by disposing plate-like permanent magnets 20 in a cylindrical arrangement. Reference numeral 21 designates a rod for control of the movement of the displacer 8, while reference numerals 22 and 23 are vortical blade springs. The aforesaid electromagnetic coil 19 is wound around a laminated core 24, said laminated core 24 being provided integrally with the core 19 and etc. by a holder 25 provided at both sides thereof.

The cylinder 7 is made from aluminum alloy, having at least the inner surface thereof hardened, by so-called almite treatment or the like. The outer peripheral surface of the cylinder 7 is formed with a protrusion or bar 26 which slightly protrudes therefrom in a coaxial manner with respect to the cylinder 7. The bar 26 is worked so as to allow the outer periphery thereof to take a shape approximated to a perfect circle, adjacent to which is provided a male-threaded portion or male screw 27.

A mount 28, provided for fixing the cylinder 7 to the cylindrical portion 2 of the casing 1 and retaining the said drive mechanism 1, is attached to the outside of the bar 26 and the male screw 27. The mount 28 is resin-made, comprising: an attachment portion 29 which is shaped into a short cylinder configuration, defining an attachment hole 29A in the center thereof; and a flange 30 formed integrally with the attachment portion 29. The inner periphery of the attachment portion 29 is formed with a recess 31 provided coaxially with the attachment portion 29. The recess 31 thus peripherally formed defines an inside diameter substantially equal to the outside diameter of the aforesaid bar 26 that is also peripherally formed, with the inner periphery of the recess 31 being approximated to a perfect circle. Further, adjacent to the recess 31 is formed a female-threaded portion or female screw 32 which can engage the male screw 27. The flange 30 is provided with a plurality of through-holes 33 arranged at equal intervals. By engaging the female screw 32 of the mount 28 with the male screw 27 of the cylinder 7, the mount 28 is attached to the outer periphery of the cylinder 7. At that time of moment, the bar 26 on the outer periphery of the cylinder 7 is inserted into the recess 31 of the mount 28, whereby the mount 28 is properly positioned, coaxially with the cylinder 7.

As is apparent from the foregoing, the mount 28 fixed to the cylinder 7 serves to fix the cylinder 7 to the casing 1 and retain the drive mechanism 16. More specifically, a bracket 34 protruding inwardly from the inner periphery of the distal portion of the main body 3 and the aforesaid flange 30 are each formed with a through-hole 33, into which is inserted a bolt 35 which is then tightened by a nut 36 to thereby fix the cylinder 7 to the casing 1, while a holder 25 has a distal portion abutted to the flange 30, whereby the laminated core 24 and the drive mechanism 16 are retained by the mount 28.

Next, a method for manufacturing the cylinder 7 and the mount 28 will be described. The cylinder 7 is formed into an approximately cylindrical shape by machining a pole-shaped aluminum alloy material which is slightly thicker than the outside diameter of the aforesaid bar 26 so that the inner periphery of the cylinder 7 and the outer periphery of the bar 26 may define a perfect-circle-shaped section, each of which extending coaxially, defining a constant diameter in the respective axial direction. On the other hand, whilst the mount 28 is formed by integral molding, the inner periphery of the recess 31 may be machined if necessary so that the section thereof may take a perfect-circle shape, extending coaxially, defining a constant diameter in the axial direction. By screwing the male screw 27 into the female screw 32 of the mount 28, the mount 28 is firmly attached to the outer periphery of the cylinder 7.

With the structure thus made, an alternate current is allowed to flow in the electromagnetic coil 19, so that an alternate magnetic field occurs to thereby develop a force to move the group of magnets 18 toward the axial direction. This force allows the piston 15 to make a reciprocal movement in the axial direction inside the cylinder 7. Thus, when the piston 15 moves toward the displacer 8, a gas within the compression chamber C formed between the piston 15 and the displacer 8 is compressed, and then passes through the communication hole 11, heat dissipating fin 13, regenerator 10, heat absorbing fin 12, and the space 9 to reach the expansion chamber E formed between the distal end of the displacer 8 and the distal portion 6 of the cylindrical portion 2, whereby the displacer 8 is pushed downward. On the other hand, when the piston 15 moves away from the displacer 8, a negative pressure is applied to the interior of the compression chamber C, and thus the gas is allowed to return to the chamber C inside the cylinder 7, through the space 9, heat absorbing fin 12, regenerator 10, heat dissipating fin 13, and communication hole 11, whereby the displacer 8 is pushed upward.

Through such steps, the operation of a reversible cycle consisting of isothermal change and isovolumic change is carried out, whereby the temperature of the heat absorbing fin 12 attached to the peripheral tip end of the cylinder 7 is lowered, while the temperature of the outer heat dissipating fin 14 attached to the outer periphery of the base 4 is raised.

It should be noted that during the above operation, as the mount 28 is made of synthetic resin of a low heat conductance, the heat emitted from the drive mechanism 16 is capable of being prevented from transferring to the cylinder 7 via the mount 28, or to the compression chamber C inside the cylinder 7, so that the thermal expansion of the cylinder 7 due to the heat from the drive mechanism 16 can be prevented, to thereby avoid the damage to the stirling cycle operation.

As is apparent from the foregoing, a stirling cycle engine according to the foregoing embodiment comprises: the casing 1 at least including the substantially cylinder-shaped cylindrical portion 2; the metallic cylinder 7 coaxially inserted into the cylindrical portion 2 of the casing 1; the piston 15 inserted into the cylinder 7; the drive mechanism 16 for reciprocally driving the piston 15; and the mount 28 attached to the outer periphery of the cylinder 7, said mount 28 being provided for fixing the cylinder 7 to the casing 1 and retaining the drive mechanism 16. As the cylinder 7 and the mount 28 are constructed independently of each other such that the mount 28 is attached to the outer periphery of the cylinder 7, the easier working thereof is resulted, thus shortening the working time, improving productivity, and reducing working costs.

Further, as the mount 28 is made of material of low heat conductance, approximately disc-shaped, having the attachment hole 29A in the center thereof, the heat emitted from the drive mechanism 16 is capable of being prevented from transferring to the cylinder 7 via the mount 28, or to the compression chamber C inside the cylinder 7, so that the thermal expansion of the cylinder 7 due to the heat from the drive mechanism 16 can be prevented, to thereby avoid the damage to the stirling cycle operation.

Furthermore, the outer peripheral surface of the cylinder 7 is formed with the bar 26 and the male screw 27 provided in a coaxial manner with respect to the cylinder 7, while the inner periphery of the mount 28 is formed with the recess 31 and the female screw 32 provided coaxially therewith so that the said bar 26 may be inserted into the recess 31 with a slight clearance therebetween and the said male screw 27 may be screwed into the female screw 32, whereby the mount 28 can be easily and securely attached to the cylinder 7, thus realizing accurate assembling, using a simple structure.

Incidentally, the present invention should not be limited to the foregoing embodiments, but may be modified within the scope of the invention. For example, the material of said cylinder may be steel or any other type of metallic alloy if it meets the requirements including hardness and strength. Further, although the male screw is provided adjacent to the distal end of the bar in the foregoing embodiment, the bar may be provided adjacent to the distal end of the male screw. In that case, the positional relationship between the recess of the mount and the female screw thereof should be reversed. In addition, whilst the flange is integrally provided at the proximal end of the attachment portion in the foregoing embodiment, it may be provided at any other suitable portion thereof, such as the distal end of thereof.

What is claimed:

1. A stirling cycle engine which comprises:

a casing which at least has a substantially cylinder-shaped cylindrical portion;

a metallic cylinder that is coaxially inserted into the casing;

a piston inserted into the cylinder;

a drive mechanism for reciprocally driving the piston, and a mount which is attached to an outer periphery of said cylinder for fixing the cylinder to said casing and retaining said drive mechanism, wherein said mount is made of a material of low heat conductance, substantially disc-shaped, having an attachment hole in the center thereof.

2. A stirling cycle engine according to claim 1, further comprising:

a bar and a male screw which are formed around the outer periphery of said cylinder coaxially therewith; and a recess and a female screw which are formed around an inner periphery of said mount coaxially therewith so that said bar may be inserted into the recess with a slight clearance therebetween and the said male screw may be screwed into said female screw.

3. A stirling cycle engine according to claim 1, wherein said mount is made of resin, constructed of an attachment portion which is shaped into a short cylinder, defining said attachment hole in the center thereof; and a flange formed integrally with the attachment portion.

4. A stirling cycle engine according to claim 2, wherein said mount is made of resin, constructed of an attachment portion which is shaped into a short cylinder, defining said attachment hole in the center thereof; and a flange formed integrally with the attachment portion.

5. A stirling cycle engine according to claim 2, wherein said male screw is formed adjacent to said bar, while said female screw is formed adjacent to the said recess, corresponding to said male screw.

6. A stirling cycle engine according to claim 3, further comprising a bracket protruding inwardly from an inner periphery of a distal portion of a main body of said casing; and a plurality of through-holes formed in the bracket and said flange, so that a bolt may be inserted into each through-hole and then tightened by a nut to thereby fix the cylinder to the casing.

7. A stirling cycle engine according to claim 4, further comprising a bracket protruding inwardly from an inner periphery of a distal portion of a main body of said casing; and a plurality of through-holes formed in the bracket and said flange, so that a bolt may be inserted into each through-hole and then tightened by a nut to thereby fix the cylinder to the casing.

8. A stirling cycle engine according to claim 2, wherein said cylinder is made of aluminum alloy, having at least an inner surface hardened by almite treatment.

9. A stirling cycle engine according to claim 2, wherein the inner periphery of said cylinder and the outer periphery of said bar define a perfect-circle-shaped section, each of which extending coaxially, defining a constant diameter in the axial direction, while the inner periphery of said recess also defines a perfect-circle shape section, extending coaxially, defining a constant diameter in the axial direction.

10. A stirling cycle engine according to claim 3, wherein the inner periphery of said cylinder and the outer periphery of said bar define a perfect-circle-shaped section, each of which extending coaxially, defining a constant diameter in the axial direction, while the inner periphery of said recess also defines a perfect-circle shape section, extending coaxially, defining a constant diameter in the axial direction.

* * * * *